United States Patent [19]

Liao

[11] Patent Number: 5,013,224

[45] Date of Patent: May 7, 1991

[54] FAN ASSEMBLY

[76] Inventor: Yin-Chieh Liao, No. 106, Lane 6, Sec. 1 Chung-Shan Road, Ta-Tsuen Hsiang, Changhua Hsien, Taiwan

[21] Appl. No.: 447,204

[22] Filed: Dec. 7, 1989

[51] Int. Cl.[5] ..... E04B 35/04; B63H 3/00; H01R 39/00

[52] U.S. Cl. ..... 417/423.5; 417/423.1; 416/100; 439/12; 439/18

[58] Field of Search ..... 417/423.1, 423.5; 415/60, 61; 416/246, 247 R, 100; 439/11, 12, 13, 18

[56] References Cited

U.S. PATENT DOCUMENTS 1,094,541 4/1914 Dilg ..... 416/100
1,741,736 12/1929 Richardson ..... 416/100
4,472,110 9/1984 Sun Keu ..... 416/100

FOREIGN PATENT DOCUMENTS 1116768 11/1961 Fed. Rep. of Germany ..... 439/12
2136877 9/1984 United Kingdom ..... 415/60

OTHER PUBLICATIONS

IBM Technical Disclosure, H. J. Bechtler, vol. 22, No. 6, Nov. 1979.

*Primary Examiner*—Leonard E. Smith
*Assistant Examiner*—John A. Savio, III
*Attorney, Agent, or Firm*—Merchant, Gould, Smith, Edell, Welter & Schmidt

[57] ABSTRACT

A fan assembly includes a statonary support holding a rotary support operated by a motor for turning 360 degrees about a vertical axis and a plurality of fan units mounted on the rotary support. First conductors are provided to connect the motor and the fan units to rotary conducting plates which respectively contact stationary second conducting plates, and second conductors are connected to the second conducting plates, thereby preventing the conductors of the assembly from becoming tangled.

8 Claims, 5 Drawing Sheets

FAN ASSEMBLY

BACKGROUND OF THE INVENTION

This invention relates to a fan assembly, and particularly to a fan assembly including a support which rotates 360 degrees about a vertical axis and a plurality of fan units mounted on the rotary support.

Various fan devices have been provided in the art. A typical fan device includes an upright stationary support on which is mounted a turnable motor housing with a fan blade unit. The motor housing turns about 180 degrees so as to permit the fan blade to circulate currents of air within a wide area. However, constant air circulation cannot be maintained within the entire 180 degree area because a portion of the area cannot be ventilated at the same time as the other portion due to the presence of a single fan blade unit. Moreover, the area that can be ventilated by the conventional fan is limited.

SUMMARY OF THE INVENTION

An object of the invention is to create currents of air in all directions so that efficient air circulation can be achieved within a wide area.

According to the present invention, a fan assembly comprises: a stationary support: a rotary support mounted on the stationary support for rotation about the axis of the stationary support: a first motor connected to the rotary support so as to rotate the rotary support; a plurality of fan units mounted on the rotary support, each of the fan units being provided with a second motor; a first conductor connected to the first motor; second conductors respectively connected to the second motors; first conducting plates mounted to the rotary support to rotate simultaneously with the rotary support, each of the first conducting plates connected to each of the second conductors and having a first annular conductive face; second conducting plates each provided between adjacent two of the first conducting plates, the second conducting plates being stationary and each having a second annular conductive face in contact with one of the first annular conductive faces; and third conductors respectively connected to the second conducting plates.

In one aspect of the invention, the stationary support includes an upright support, a stationary shaft extending upward from the upright support and an annular bearing face around a bottom end of the stationary shaft. The rotary support includes a hollow cylindrical shell provided around the shaft, a bottom cover provided at the bottom end of the shell and resting on the annular bearing face, a top cover at the top of the hollow cylindrical shell to support the fan units, and a core-like annular member extending from the inner surface of an intermediate portion of the hollow cylindrical shell, the core-like annular member confining a stepped central axial bore receiving the shaft. The stationary shaft has a locking nut associated with and received in a portion of the stepped central axial bore so as to clamp the core-like annular member against the bottom cover. The first motor is mounted on the core-like annular member and has a shaft connected to the shaft of the upright support. The first and second conducting plates are provided in the lower chamber below the core-like annular member and clamped against one another so that the annular conductive faces of the first and second conducting plates contact each other. The second and third conductors are arranged in such a manner that they are not tangled when the rotary support rotates.

The present exemplary preferred embodiment will be described in detail with reference to the accompanying drawings, in which:

DETAILED DESCRIPTION OF THE PREFERRED EMBODIMENT

Figure 1:
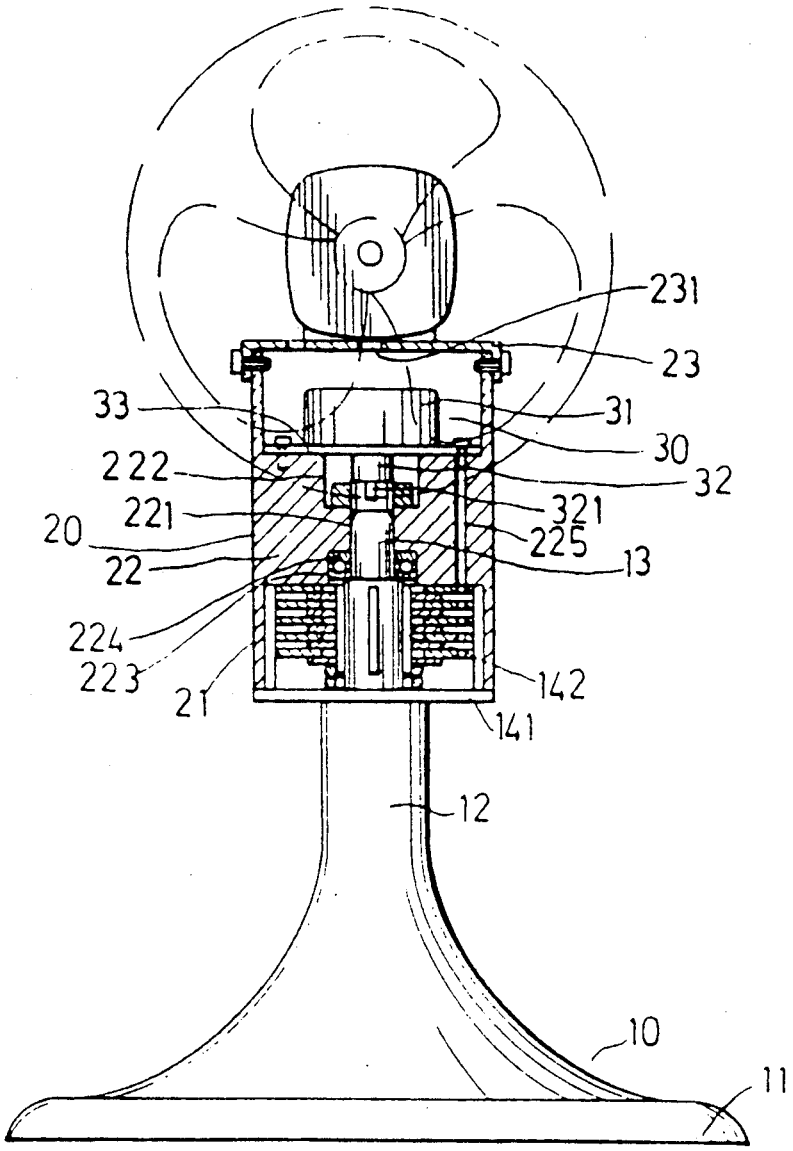
FIG. 1 is a sectional view of a fan assembly embodying the present invention.
Figure 2:
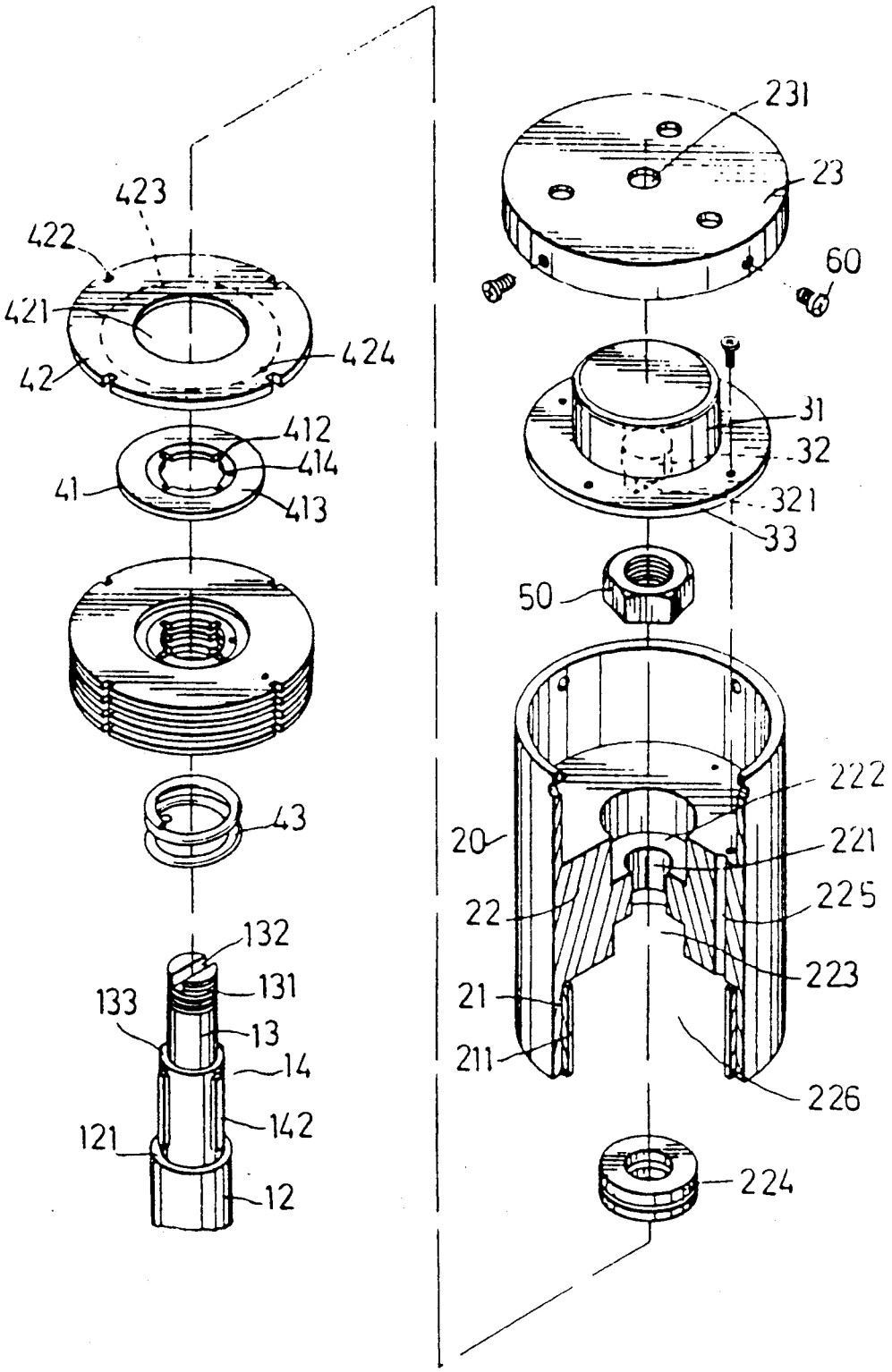
FIG. 2 is an exploded view of the fan assembly of FIG. 1.

Referring to FIGS. 1 and 2, a preferred embodiment of the present invention is shown, having a stationary base 11 and an upright support 12 fixed to said base 11. The upright support 12 is hollow and cylindrical and has an annular top bearing face 121. A shaft 14 extends from the top of the upright support 12 and has a restricted shaft portion 13 and a shoulder 133. A screw thread 131 and a diametric groove 132 are provided in the restricted shaft portion 13.

A hollow cylindrical rotary support 20 is mounted on the upright support 12, having a hollow cylindrical shell 21 and a core-like annular member 22 extending from the inner surface of an intermediate portion of the shell 21. A bottom cover 141 is provided around the shaft 14 and rests on the bearing face 121. The core-like annular member 22 is provided with a stepped central bore including three bore portions 221, 222 and 223. The bore portion 221 receives the restricted shaft portion 13 in a manner which permits the rotary support 20 to rotate relative to the shaft portion 13. A bearing assembly 224 is received in the bore portion 223 and a locking nut 50 is received in the bore portion 222. The locking nut 50 engages with the screw thread 131 of the restricted shaft portion 13 and clamps the core-like annular member 22 and the shell 21 against the bottom cover 141 which in turn bears against the bearing face 121 of the upright support 12. A lower chamber 226 is provided cover 141. Annular conducting plates 41 are provided around the shaft 14 in the chamber 226 and each plate 41 has four notches 412 at the inner edge thereof to engage with keys 142 of the shaft 14, thereby immobilizing the annular conducting plates 41 relative to the shaft 14. A hole 414 is provided in each annular guide plate 41 at a location offset from the shaft 14. Each annular conducting plate 41 is provided with an annular conductive face 413 by overlaying a conductive plate, made of a material such as copper on one side of each conducting plate 41.

Annular conducting plates 42 are provided around the shaft 14 in the chamber 226, each between two adjacent annular conducting plates 41. The diameter of the conducting plates 42 is greater than that of the conducting plates 41. The periphery of each conducting plate 42 is provided with four notches 422 to engage with keys 211 of the cylindrical shell 21 so that the conducting plates 42 can rotate together with the rotary support 20. The guide plate 42 are respectively provided with an annular conductive face 423 by overlaying a conductive plate such as a copper plate on one side adjacent to said conductive face 413. A spring 43 is provided between the bottom most annular conducting plate 41 and the bottom cover 141 of the rotary support 20 to urge said conducting plates 41, 42 toward the core-like annular member 22, thereby keeping the annular conductive faces 413 and 423 in contact with each other. The diameter of the central holes 421 of the conducting plates 42 is greater than that of the shaft portion 13 thereby creating an annular space around the restricted shaft portion 13. A hole 424 is provided in each conducting plate 42 in a position radially offset from the shaft portion 13. An axial bore 225 is provided in the core-like annular member 22 in alignment with the holes 424 of the conducting plates 42.

A motor 31 is provided in an upper chamber 30 of the rotary support on the core-like annular member 22 of the rotary support 20 and has a shaft 32 which is provided with a diametric cross protrusion 321. The protrusion 321 of the shaft 32 is inserted into the groove 132 of the restricted shaft portion 13. An annular flange 33 of the motor 31 is secured to the core-like annular member 22 of the rotary support 20 by means of screws. This arrangement permits the rotary support 20 to rotate about the restricted shaft portion 13 and the shaft 14 when the motor 31 operates. A top cover 23 is attached to the top of the shell 21 of the rotary support 20 by using screws 60.

Figure 4:
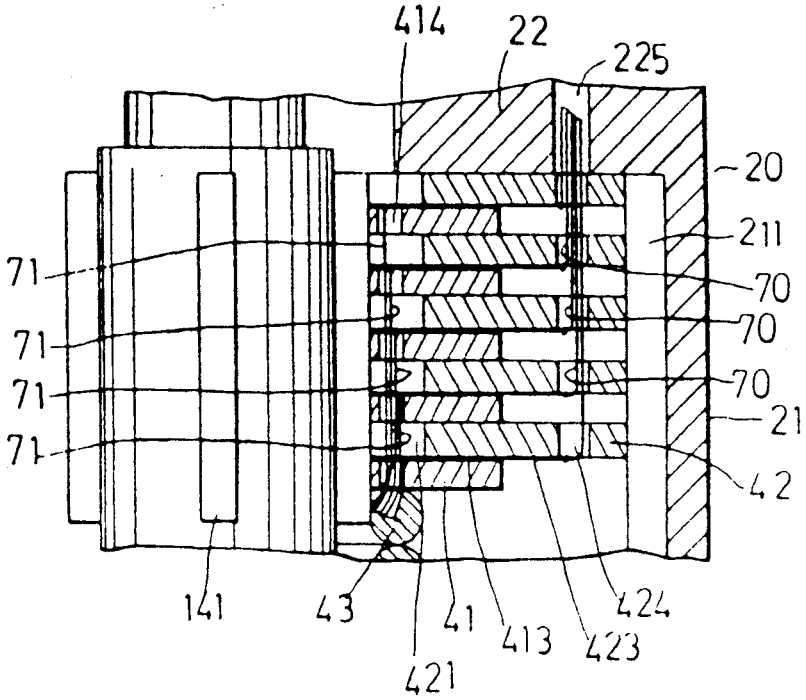
FIG. 4 is a fragmentary sectional view of the rotary support of the fan assembly.

Three fan units 50 are mounted on the top cover 23 of the rotary support 20 at equal angular distances, i.e. 120 deg. Each fan unit 50 has a motor 51 and a the motor 31 are connected to the conducting plates 42 using conductors 70 which pass through the bore 225 the core-like annular member 22 and the holes 424 of the conducting plates 42 as shown in FIG. 4. These conductors 70 turn together with the motors 51, 31 as the rotary support 20 rotates. Conductors 71 are connected to the conducting plates 41 and extend downward through the annular spaces of the holes 421 of the conducting plates 42 and the holes 414 of the conducting plates 41. The purpose of arranging the conductors 70 and 71 as described above is to prevent the conductors of the fan assembly of the present invention from being tangled when the rotary support 20 rotates.

It can be appreciated that the fan assembly of the in all directions since a plurality of fan blades are mounted on a rotary support which turns 360 deg. The fan assembly can be regulated such that only one fan unit operates, or some or all of the fan units operate. Moreover, heating elements 53 can be associated with the fan units 50 as shown by phantom lines in FIG. 3, so as to produce warm air in a cold area.

Figure 3:
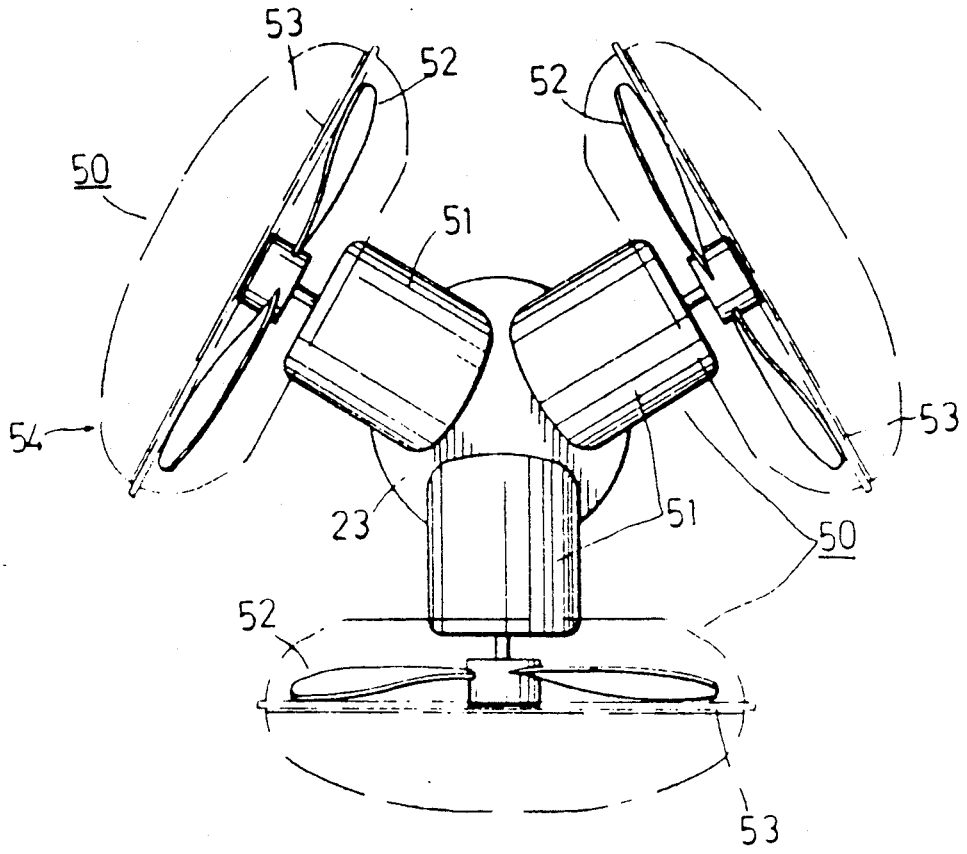
FIG. 3 is a top plan view of the fan assembly of FIG. 1.
Figure 5:
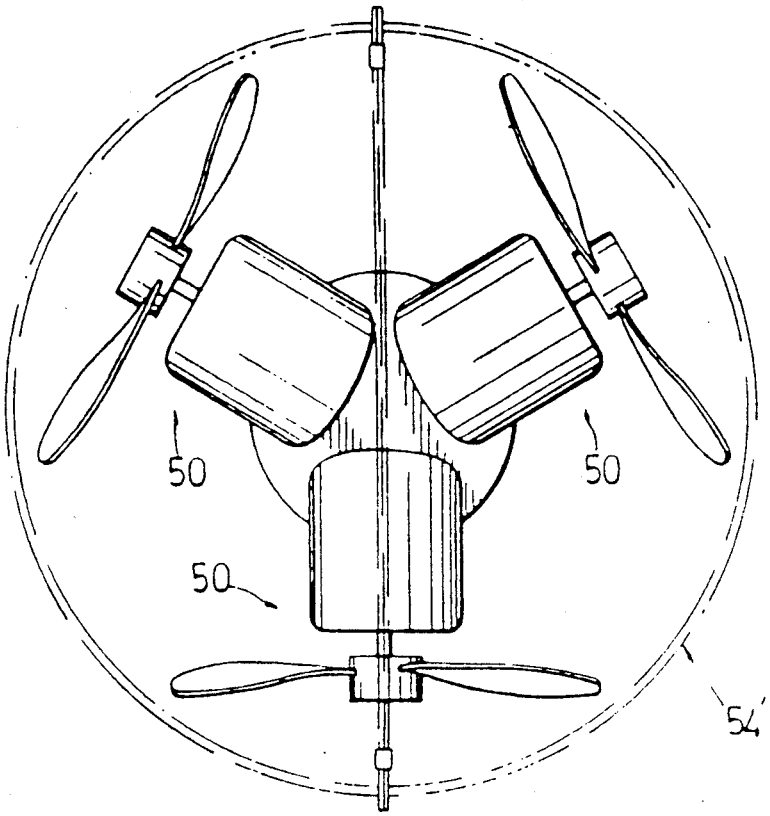
FIG. 5 is a top plan view showing an alternative arrangement of the fan units of the invention.

In addition to the arrangement of the fan units 50 shown in FIG. 3 in which the fan blade 52 are individually accommodated in grilled housings 54, the fan units 50 can be arranged such that they are housed in a single grilled housing 54' as shown in FIG. 5.

With the invention thus explained, it is apparent that various modifications and variations can be made without departing from the scope of the invention. It is therefore intended that the invention be limited only as indicated in the appended claims.

What is claim is:

1. A fan assembly comprising:

a stationary support:

a rotary support mounted on said stationary support for rotation about the axis of said stationary support;

a first motor connected to said rotary support so as to rotate said rotary support;

a plurality of fan units mounted on said rotary support, each of said fan units being provided with a second motor;

a first conductor connected to said first motor;

second conductors respectively connected to said second motors;

first conducting plates mounted to said rotary support to rotate simultaneously with said rotary support, each of said first conducting plates connected to each of said second conductors and having a first annular conductive face;

second conducting plates each provided between two adjacent said frist contacting plates, said second conducting plates being stationary and each having a second annular conductive face in contact with said first annular conductive face; and third conductors respectively connected to said second conducting plates.

2. A fan assembly as claimed in claim 1, wherein said stationary support includes an enlarged base and an upright support extending from said enlarged base, said upright support having a shaft extending upward therefrom and an annular bearing face around a bottom end of said shaft.

3. A fan assembly as claimed in claim 2, wherein said rotary support includes a hollow cylindrical shell around said shaft, a bottom cover resting on said annular bearing face and abutting with the bottom end of said hollow cylindrical shell, a top cover at the top of said hollow cylindrical shell to support said fan units, and a core-like annular member extending from the inner surface of an intermediate portion of said hollow cylindrical shell, said core-like annular member confining a stepped central axial bore receiving said shaft, said shaft having a locking nut associated with and received in a portion of said stepped central axial bore, said locking nut clamping said core-like annular member against said bottom cover.

4. A fan assembly as claimed in claim 3, wherein said rotary support includes a lower chamber between said bottom closed end and said core-like annular member, and an upper chamber between said top cover and said core-like annular member.

5. A fan assembly as claimed in claim 4, wherein said first motor is provided in said upper chamber and mounted on said core-like annular member, said first motor having a shaft connected to said shaft of said upright support.

6. A fan assembly as claimed in claim 5, wherein said first and second conducting plates are provided in said lower chamber around said shaft of said upright support, said first conducting plates having a diameter greater than that of said second conducting plates, said first conducting plates being engaged with said hollow cylindrical shell and rotatable relative to said shaft of said upright support, said second conducting plates being engaged with said shaft of said upright support, said rotary support further having a coil spring provided around said shaft of said upright support between said bottom cover and the assembly of said first and second conducting plates.

7. A fan assembly as claimed in claim 6, wherein each of said first conducting plates includes a central first hole and a second hole which is radially offset from said central first hole, said core-like annular member having an axial bore which is offset radially from said stepped central axial bore of said core-like annular member, said second conductors extending from said first annular conductive face of said first conducting plates to said fan units through said second hole and said axial bore of said core-like annular member.

8. A fan assembly as claimed in claim 7, wherein the diameter of said central first holes of said first conducting plates is greater than the diameter of said shaft of said upright support so that an annular space is created in each of said first conducting plates around said shaft of said upright supports, each of said second conducting plates having a third hole which is axially aligned with said annular spaces of said first conducting plates, said third conductors extending downward from said second annular conductive faces of said second conducting plates and passing through said annular spaces of said first conducting plates and said third holes of said second conducting plates.

* * * * *

UNITED STATES PATENT AND TRADEMARK OFFICE
CERTIFICATE OF CORRECTION

PATENT NO. : 5,013,224

DATED : May 7, 1991

INVENTOR(S) : Yin-Chieh Liao

It is certified that error appears in the above-identified patent and that said Letters Patent is hereby corrected as shown below:

Title Page:
In the Abstract, line 1, "statonary" should read --stationary--;

Column 2, line 49, insert --between the core-like annular member 22 and the bottom-- after the word "provided";

Column 3, line 31, insert --fan blade unit 52. The motors 51 of the fan units and-- after the word "a";

Column 3, line 33, insert --of--after the numeral "225";

Column 3, line 46, insert --present invention can provide an effective ventilation--after the word "the";

Column 4, line 15, "frist" should read --first--;

Column 4, claim 1, line 15, "contacting" should read --conducting--

Column 4, claim 3, line 31, "." should read --,-- after the word "shell";

Column 4, claim 3, line 35, "." should read --,-- after the word "shell";

UNITED STATES PATENT AND TRADEMARK OFFICE

CERTIFICATE OF CORRECTION

PATENT NO. : 5,013,224

DATED : May 7, 1991

INVENTOR(S) : Yin-Chieh Liao

It is certified that error appears in the above-identified patent and that said Letters Patent is hereby corrected as shown below:

Column 4, claim 3, line 36, "." should read --,-- after the word "shaft";

Column 4, claim 3, line 38, "." should read --,-- after the word "bore";

Column 4, claim 4, line 43, "." should read --,-- after the word "member";

Column 4, claim 5, line 48, "." should read --,-- after the word "member";

Column 4, claim 6, lines 53 and 54, "." should read --,-- after the word "support";

Column 4, claim 7, line 67, "." should read --,-- after the word "hole";

Column 6, claim 8, line 1, "supports," should read --support,--; and

Column 6, claim 8, line 3, "." should read --,-- after the word "plates".

Signed and Sealed this

Eighth Day of December, 1992

*Attest:*

DOUGLAS B. COMER

*Attesting Officer*

*Acting Commissioner of Patents and Trademarks*